US005840462A

United States Patent [19]

Foucher et al.

[11] Patent Number: 5,840,462

[45] Date of Patent: Nov. 24, 1998

[54] TONER PROCESSES

[75] Inventors: Daniel A. Foucher, Toronto; Raj D. Patel; Guerino G. Sacripante, both of Oakville, all of Canada; Grazyna E. Kmiecik-Lawrynowicz, Fairport, N.Y.

[73] Assignee: Xerox Corporation, Stamford, Conn.

[21] Appl. No.: 6,622

[22] Filed: Jan. 13, 1998

[51] Int. Cl.[6] ..... G03G 9/09; G03G 9/087

[52] U.S. Cl. ..... 430/137

[58] Field of Search ..... 430/137

[56] References Cited

U.S. PATENT DOCUMENTS

| | | | |
|---|---|---|---|
| 4,137,188 | 1/1979 | Uetake et al. | 430/106.6 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 530/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |

*Primary Examiner*—Roland Martin
*Attorney, Agent, or Firm*—E. O. Palazzo

[57] ABSTRACT

A process for the preparation of toner which involves i) flushing a colorant into a sulfonated polyester resin;

ii) mixing an organic soluble dye with the colorant polyester resin of i);

iii) dispersing the resulting mixture into warm water thereby enabling the formation of submicron particles;

iv) allowing the resulting solution to cool below about, or about equal to the glass transition temperature of said sulfonated polyester resin;

v) adding an alkali halide solution and heating; and optionally vi) recovering said toner, followed by washing and drying.

21 Claims, No Drawings

TONER PROCESSES

PATENT AND PENDING APPLICATIONS

Illustrated in U.S. Pat. No. 5,648,193, the disclosure of which is totally incorporated herein by reference, is a process for the preparation of toner compositions comprised of (i) flushing pigment into a sulfonated polyester resin, and which resin has a degree of sulfonation of from between about 2.5 and 20.0 mol percent based on the repeat unit of the polymer; (ii) dissipation of the resulting pigmented sulfonated polyester in water at about 40° to about 75° C. to obtain particles which are in the size range of about 50 to 200 nanometers; (iii) followed by cooling the resulting mixture below about the glass transition temperature of the sulfonated polyester; and adding, dropwise, a metal salt halide such as a magnesium chloride solution to form particles of a volume average diameter of from about 3 to about 10 microns with a narrow GSD; (iv) recovering the toner particles by filtration; (v) drying the toner particles by vacuum; and (vi) optionally adding to the dry toner particles charge additives and flow aids. Also of interest may be U.S. Pat. No. 5,658,704, the disclosure of which is totally incorporated herein by reference.

The following copending applications, the disclosures of which are totally incorporated herein by reference, are being filed concurrently herewith.

U.S. Ser. No. 09/006,612 pending discloses a toner process with a first aggregation of sulfonated polyester, and thereafter, a second aggregation with a colorant dispersion and an alkali halide.

U.S. Ser. No. 09/006,640 pending discloses a toner process wherein a latex emulsion and a colorant dispersion are mixed in the presence of an organic complexing agent or compound, and wherein the latex can contain a sodio sulfonated polyester resin.

U.S. Ser. No. 09/006,521 pending discloses an emulsion/aggregation/fusing process for the preparation of a toner containing a resin derived from the polymerization of styrene butadiene, acrylonitrile, and acrylic acid.

U.S. Ser. No. 09/006,553 pending discloses a toner process wherein there is mixed an emulsion latex, a colorant dispersion, and a monocationic salt, and wherein the resulting mixture possesses an ionic strength of about 0.001 molar to about 5 molar.

U.S. Ser. No. 09/006,299 pending discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Ser. No. 09/006,508 pending discloses a toner process by blending an aqueous colorant dispersion with a latex blend containing a linear polymer and soft crosslinked polymer particles U.S. Ser. No. 09/006,742 pending discloses a toner process wherein there is mixed an aqueous colorant dispersion and an emulsion latex, followed by filtering, and redispersing the toner formed in water at a pH of above about 7 and contacting the resulting mixture with a metal halide or salt, and then with a mixture of an alkaline base and a salicylic acid, a catechol, or mixtures thereof.

The appropriate components of the above patent and copending applications may be selected for the present invention in embodiments thereof.

BACKGROUND OF THE INVENTION

The present invention is generally directed to toner processes, and more specifically, to aggregation and coalescence processes for the preparation of toner resins, such as styrenes, styrene acrylates, styrene methacrylates, and preferably polyesters, and toner compositions thereof, and which toner possesses a number of advantages, such as improved hues, chromas and a wider color gamut. In embodiments, the present invention is directed to the economical in situ, chemical preparation of toners and toner resins without the utilization of the known toner pulverization and/or classification methods, and wherein in embodiments toner compositions with a volume average diameter, as determined, for example, with a Coulter Counter, of from about 1 to about 25, and preferably from 1 to about 10 microns and narrow GSD of, for example, from about 1.16 to about 1.26, as measured on the Coulter Counter, can be obtained, and wherein molten flushed pigments, together with organic soluble dyes, are selected and wherein there can be enabled colored toners with low melting characteristics and which toners contain certain polyester resins to yield a wide color gamut. With flushed colorants, such as pigments, there is enabled a superior uniform dispersion of the pigment within the low melt resin, permitting optimum pigment polymer loading, improved toner quality and excellent optical density. When the organic soluble dye is either incorporated directly or sequentially during the flushing process or introduced at a later stage into the sulfonated polyester by a melt-extrusion process prior to, preferably subsequent to, or together with the pigment, a wider color gamut is achievable as compared to the use of colorant like pigment alone. Introduction of the organic soluble dye together with the colorant, such as pigment also allows less deposition of toner mass on paper, while simultaneously increasing the image optical density upon fusing. Furthermore, toner particles containing a combination of organic dye and pigment will, when fused, further improve the crease of a given image, since for example some of the dye molecules will penetrate into the paper fibers. In addition, intercolor bleeding, which is normally observed with either the 100 percent water soluble dyes or organic dye systems, is reduced or absent with the present process which utilizes a mixture of an organic soluble dye and colorant like a pigment.

More specifically, with the processes of the present invention in embodiments, the use of surfactants can be avoided, for example a nonionic surfactant is not needed to disperse the pigment selected, cationic surfactant is not needed to perform the aggregation, and the anionic surfactant selected to stabilize the aggregated particles when heated to about 20° C. to about 40° C. above the resin Tg during the coalescence, reference for example U.S. Pat. No. 5,403,693, the disclosure of which is totally incorporated herein by reference, and washing to remove surfactants can be eliminated. The process of the present invention enables the utilization of polymers obtained by polycondensation reactions, such as polyesters, and more specifically, the sulfonated polyesters as illustrated in U.S. Pat. Nos. 5,660,965 and 5,348,832, the disclosures of which are totally incorporated herein by reference, and which polyesters can be selected for low (less than about <135° C.) melting toners; and with the processes of the present invention there are generated flushed colorant polyesters, followed by the introduction of an organic soluble dye either directly, sequentially or subsequent to the flushing of the colorant, wherein the polyester has a varying degree of sulfonation which, upon dissipation in warm water, results in particles of submicron dye-pigmented particles of from about 50 to about 200 nanometers in size, which particles are then aggregated to toner size, about 2 to about 20 microns, and wherein the charging and fusing of the toners containing the sulfonated polyester are not substantially adversely affected by residual surfactants. Further embodiments of the present invention also reside in less amount of toner mass on paper which enables a wider color gamut, and enables enhanced optical density as compared to pigmented toners alone.

The toners obtained with the processes of the present invention can be selected for known electrophotographic imaging methods, printing processes, including color processes, digital processes, and lithography.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. Other prior art includes U.S. Pat. Nos. 3,674,736; 4,137,188 and 5,066,560.

Emulsion/aggregation processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of these Xerox patents may be selected for the present invention in embodiments thereof.

SUMMARY OF THE INVENTION

It is a feature of the present invention to provide a process for the preparation of toner compositions with an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter, and wherein aggregation results from cation exchange of the sodium counterions of the polyester sulfonate groups for dicationic ions, such as magnesium.

In a further feature of the present invention there is provided a process for the preparation of toners with a particle size distribution which can be improved from about 1.4 to about 1.16 as measured by the Coulter Counter by increasing the temperature of aggregation from, for example, about 25° C. to about 45° C.

Moreover, in a further feature of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another feature of the present invention there is provided a composite toner of a sulfonated polymeric resin with pigment, dye and optional charge control agent in high yields of from about 90 percent to about 100 percent by weight of toner without resorting to classification.

In yet another feature of the present invention there are provided toner compositions with low fusing temperatures of from about 110° C. to about 150° C. and with excellent blocking characteristics at from about 50° C. to about 60° C.

Moreover, in another feature of the present invention there are provided toner compositions with a high projection efficiency, such as from about 75 to about 95 percent efficiency as measured by the Match Scan II spectrophotometer available from Milton-Roy.

In a further feature of the present invention there are provided toner compositions which result in minimal, low, or no paper curl due to the low toner mass area on paper.

In another feature of the present invention there is provided a composite toner of sulfonated polymeric resin with pigment, dye and optional charge control agent in high yields of from about 90 percent to about 100 percent by weight of toner without resorting to classification.

In yet another feature of the present invention there are provided toner compositions with low fusing temperatures of from about 110° C. to about 150° C. and with excellent blocking characteristics at from about 50° C. to about 60° C.

In a further feature of the present invention there are provided toner compositions which result in minimal, low, or no paper curl, primarily in view of the low toner mass area on paper.

Embodiments of the present invention include the provision of dry toner compositions comprised of a dye-pigmented sulfonated polyester resin prepared by the molten flushing of a colorant like a pigment, followed by the addition of an organic soluble dye into the flushed polyester by melt extrusion, flushing a dye-pigment mixture with a molten polyester, or selecting a sequential flushing process of pigment and dye with molten polyester, which mixture is then dissipated in warm water, for example water at a temperature of less than about 60° C. resulting in colorant particles, which are then aggregated and coalesced by the addition of alkali halides and processes thereof with many of the advantages illustrated herein; the provision of simple and economical chemical processes for the chemical preparation of black and colored toner compositions with, for example, excellent pigment dispersions and narrow GSD, and wherein a pigment is either flushed alone or together with an organic soluble dye in a simultaneous or sequential process into a sulfonated polyester resin, resulting in a uniform distribution of both the colorant like pigment and dye into the sulfonated polyester which upon dissipation in warm water, for example from about 40° C. to about 60° C. and stirring at speeds of, for example, from about 100 to about 5,000 rpm results in submicron pigmented/dye particles, wherein the degree of sulfonation during the synthesis of the polyester resin determines the particle size of the dispersion obtained upon dissipation, wherein flushed sulfonated polyester pigmented resin refers to either a flushed pigmented system or a flushed dye/pigmented system containing both pigment and dye, and which can be obtained in pressed cakes from Sun Chemicals.

Typically, a molten flushed pigmented system can be prepared as follows. Initially, a presscake of a colorant like a pigment or dye/pigment is generated from an aqueous dispersion thereof by removing water using techniques, such as filtration, to the extent that a presscake of pigment or dye/pigment in water is obtained containing, for example, from about 50 to about 70 weight percent of the pigment or dye/pigment solids by weight. Approximately 50 percent of the presscake is then introduced into a reactor containing a molten sulfonated polyester resin, accompanied by a high power to volume mixing for a period of from about 15 to about 30 minutes, whereby the pigment or dye/pigment system transfers itself spontaneously from the aqueous phase to the organic phase. As the pigment or dye/pigment begins to disperse, the remaining about 50 percent of pigment or dye/pigment presscake is slowly added over a period of an additional about 60 to about 90 minutes. In pigmented systems alone, the organic soluble dye to broaden or increase the color gamut is introduced into the pigmented polyester by melt extrusion. The pigmented sulfonated resin is brought into the melt (>150° C.) and with stirring organic soluble dye is subsequently added. The dye is substantially completely soluble in the pigmented resin with mixing, and the dye-pigmented polyester resin obtained with the processes of the present invention can easily be dispersed in warm water at a temperature of, for example, from about 40° C. to about 100° C. Also, in embodiments the present invention relates to the provision of a method for the preparation of submicron dye-pigmented particles in the size range of from about 50 to about 200 nanometers, which particles are then aggregated and coalesced in the presence of an aqueous alkali halide, such as a magnesium chloride solution. The preparation of pigmented toner particles in the size range of, for example, from about 3 to about 10 microns comprises (i) synthesizing a sulfonated polyester resin having a degree of sulfonation in the range of, for example, from about 2.5 to about 20 mol percent; (ii) followed by adding a flushed pigmented or mixture of a dye/pigmented resin by a molten flushing process; (iii) incorporating an organic soluble dye into the pigmented sulfonated polyester by a melt mixing process at a temperature of about more than, or about equal to 150° C.; (iv) thereafter dissipating the resulting dyed-flushed pigmented resin into warm water and which water is at a temperature in the range of, for example, about 40° C. to about 95° C., depending on the resin Tg by stirring at a speed of, for example, from about 100 to about 5,000 rpm for a period of, for example, about 1 to about 20 minutes, resulting in submicron pigmented size particles in the range of from about 50 to about 200 nanometers; (v) adding an aqueous alkali metal like a magnesium chloride solution, the concentration of which is in the range of, for example, about 0.5 to about 5 percent by weight of water, to the submicron particles during heating, and after cooling, up to a temperature of from about 3° C. to about 10° C. below the resin Tg, or adding the magnesium chloride solution upon reaching a temperature of from about 3° C. to about 10° C. below the resin Tg to induce aggregation over a period of from about 30 to about 90 minutes; and (vi) isolating, washing and drying the resulting toners. The toners obtained possess, for example, excellent pigment dispersions, high gloss and low melt characteristics. The chemical toner process of aggregation can be kinetically controlled in that an increase in temperature at which the aggregation/coalescence is accomplished results in larger particle size. Also, since no extra stabilizer needs to be utilized between the aggregation and coalescence temperature process control and the rate of the addition of the halide like the magnesium chloride solution need to be monitored precisely.

Also disclosed are emulsion/aggregation/coalescence processes for the preparation of toners wherein the use of surfactants for the purpose of aggregating the anionically charged latex with cationically charged pigment particles containing a nonionic dispersant and added stabilizer added prior to the coalescence, reference, U.S. Pat. No. 5,403,693, is avoided by utilizing a flushed pigmented or dye-pigmented resins, which can be modified further to improve the color gamut and reduce the pigment content by the simultaneous or sequential introduction of organic soluble dyes during the flushing process or subsequently by the introduction of the organic soluble dye by, for example, melt extrusion.

The present invention relates to obtaining emulsion pigmented particles which can be aggregated and then coalesced, or wherein the emulsion pigmented particles are aggregated and coalesced simultaneously in one step, and wherein the use of surfactants are avoided and wherein flushed pigments together with suitable organic soluble dyes, available from sources, such as Eastman Kodak, are selected, and which flushed pigments can be obtained from a number of sources, such as Sun Chemicals. The dyed-pigmented resins can be prepared by a number of methods including displacing, or flushing water into a pigment press cake with molten sulfonated polyester, removing excess water by vacuum drying, introducing the dried pigmented sulfonated polyester back into the melt (>150° C.), followed by the incorporation of the thermally stable organic soluble dye via melt extrusion, or alternatively utilizing either simultaneous or sequentially flushing of the dye with the pigment presscake, cooling to room temperature, followed by dispersing the dyed-pigmented resin in warm (>60° C.) water with a polytron, and wherein the pigment loading can be varied to be from about 45 to about 50 weight percent, and wherein the organic soluble dye loading can be varied from about 0.1 to about 20 percent by weight, and wherein the dyed-pigmented particles are submicron in size, for example from about 30 to about 150 nanometers.

Embodiments of the present invention relate to a process for the preparation of dry toner compositions comprised of sulfonated polyester resin containing a flushed colorant, like a flushed pigment, and an organic soluble dye, and which process comprises preparing a dye-pigmented mixture by the molten flushing of pigment followed by the addition or introduction of an organic soluble dye into the flushed polyester by melt extrusion, flushing a dye-pigment mixture with a molten polyester, or using a sequential flushing process of pigment and then dye with molten polyester, followed by dissipating the dye-pigmented system in water to obtain submicron sized, for example, less than or equal to about 1 micron, and more specifically, from about 0.05 to about 0.99 micron, dye/colorant, like pigment sulfonated polyester particles. The degree of sulfonation during the preparation of the sulfonated polyester resin can be a primary factor in determining the size of the submicron particles obtained during the dissipating step. More specifically, the process relates to the preparation of toner by (i) the flushing of a pigment or dye-pigment either directly or sequentially, that is pigment first, then dye, into a sulfonated polyester resin, and wherein the flushing is preferably accomplished by the molten process as described in U.S. Pat. No. 5,658,704, the disclosure of which is totally incorporated herein by reference; (ii) incorporating an organic soluble dye into the pigmented sulfonated polyester by a melt extrusion process preferably by heating at a temperature of less than about 150° C., and more specifically, from about 100° C. to about 125° C.; (iii) dissipating the resulting mixture in warm water, which water is, for example, at a temperature of from about 35° C. to about 60° C. to obtain submicron dye or dyed-pigmented sulfonated polyester particles which are in the size range of from about 50 to about 200 nanometers; (iv) followed by heating/cooling the resulting mixture below about the glass transition temperature of the sulfonated polyester; and thereafter, adding a metal salt halide, such as magnesium halide and preferably an aqueous magnesium chloride solution, wherein the concentration of the solution is in the range of from about 0.5 to about 5 weight percent; or optionally adding the magnesium chloride solution during the heating from room temperature to a temperature below the resin Tg, and wherein the particles obtained are in the size range of from about 3 to about 7 microns in volume average diameter, and more generally with an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter, and wherein aggregation results from cation exchange of the sodium counterions of the polyester sulfonate groups for dicationic ions, such as magnesium.

In embodiments of the present invention, there are provided processes for the economical preparation of toner compositions comprising a sulfonated polyester flushed with a pigment or dye-pigment press cake, optionally melt extruding the pigment resin with an organic soluble dye, followed by dispersing the dye-pigment resin into warm water to obtain submicron pigmented particles, which are then aggregated to toner size by adding an alkali halide, such as magnesium chloride, while heating to a temperature in the range of about 3° C. to about 10° C. below the resin Tg; or heating the submicron particles to a temperature in the range 3° C. to 10° C. below the resin Tg while stirring, followed by the addition of the alkali, like magnesium chloride solution to enhance the aggregation; followed by further heating for a period of from about 30 to about 90 minutes to enable coalescence of the submicron pigmented particles, and thereafter isolating, coating, and washing with, for example, water to remove any residual salts, and then drying.

The present invention also relates to a process for the preparation of toner particles comprised of resin, pigment and dye, and which process comprises either (i) flushing a pigment into a sulfonated polyester where the degree of sulfonation on a mol percent basis is between 2.5 and 10 mol percent, followed by extrusion of the pigmented sulfonated resin with an organic soluble dye or optionally flushing into a sulfonated polyester both a pigment and dye by either a simultaneous or sequential process, and thereafter adding the product resulting to warm water at a temperature of about 40° C. to about 90° C. to yield stable submicron sized particles in the size range of about 5 to about 200 nanometers; (ii) thereafter the resulting submicron dye-pigmented particles are then aggregated to a toner size by adding an alkali halide such as magnesium chloride while heating to a temperature in the range of about 3° C. to about 10° C. below the resin Tg; or heating the submicron particles to a temperature in the range 3° C. to 10° C. below the resin Tg while stirring, followed by the addition of the magnesium chloride solution to enhance the aggregation; followed by further heating for a period of about 30 to about 90 minutes above the resin Tg to enable coalescence of the submicron pigmented particles, thereby enabling the formation of toner sized particles, and which particles are of a volume average diameter of from about 3 to about 15 microns with a narrow GSD; (iii) recovering said toner composition, or said toner particles by filtration; (iv) drying said toner particles by vacuum; and (v) adding to said dry toner particles charge additives and flow aids.

The present invention is directed to a process for the preparation of toner which comprises i) flushing a colorant into a sulfonated polyester resin;

ii) mixing an organic soluble dye with the colorant polyester resin of i);

iii) dispersing the resulting mixture into warm water thereby enabling the formation of submicron particles;

iv) allowing the resulting solution to cool below about, or about equal to the glass transition temperature of said sulfonated polyester resin;

v) adding an alkali halide solution and heating; and optionally vi) recovering said toner, followed by washing and drying; a process wherein i) said sulfonated polyester resin has a sulfonation amount of from about 2.5 and about 20 mol percent based on the repeat unit of the polymer;

ii) said mixing is accomplished by melt mixing an organic soluble dye into the colorant polyester resin of i);

iii) wherein said water is at a temperature of from about 40° C. to about 95° C., and which dispersion is by a high speed shearing polytron device operating at speeds of from about 100 to about 5,000 revolutions per minute thereby enabling the formation of stable submicron particles, and which particles are of a volume average diameter of from about 5 to about 150 nanometers;

iv) allowing the resulting solution to cool to from about 5 to about 10° C. below the glass transition temperature of said sulfonated polyester resin;

v) adding an alkali halide solution, which solution contains from about 0.5 percent to about 5 percent by weight of water, followed by stirring and heating from about 25° C. to a temperature below the sulfonated polyester resin Tg to induce aggregation of said submicron particles to obtain toner size particles of from about 1 to about 20 microns in volume average diameter; or subsequently stirring and heating to a temperature below the resin Tg, followed by the addition of alkali metal halide until the desired toner size of from about 1 to about 20 microns in volume average diameter is achieved; and vi) recovering said toner by filtration, followed by washing and drying, and thereafter optionally blending charge enhancing additives and flow additives; a process for the preparation of toner comprised of i) flushing a colorant and dye into a sulfonated polyester resin, and which resin has a degree of sulfonation of from between about 2.5 and about 20 mol percent based on the repeat unit of the polymer;

ii) dispersing the resulting sulfonated colorant polyester resin into warm water, which water is at a temperature of from about 40° C. to about 95° C. by a high speed shearing polytron device operating at speeds of from about 100 to about 5,000 revolutions per minute thereby enabling the formation of stable toner sized submicron particles, and which particles are of a volume average diameter of from about 5 to about 150 nanometers;

iii) allowing the resulting solution to cool to from about 5° C. to about 10° C. below the glass transition temperature of said colorant sulfonated polyester resin;

iv) adding an alkali halide solution, which solution contains from about 0.5 percent to about 5 percent by weight of water, followed by stirring and heating from about room temperature, about 25° C., to a temperature below the resin Tg to induce aggregation of said submicron colorant particles to obtain toner size particles of from about 2 to about 20 microns in volume average diameter; or subsequently stirring and heating to a temperature below the resin Tg, followed by the addition of alkali metal halide until the desired toner size of from about 2 to about 20 microns in volume average diameter is achieved; and optionally v) recovering said toner, washing and drying said toner; a process wherein for i) there is accomplished the simultaneous flushing of colorant and dye, or sequential flushing of said colorant then subsequently said dye into said sulfonated polyester resin; wherein said water is at a temperature of from about 40° C. to about 75° C., and said dispersing is by a high speed shearing polytron device operating at speeds of from about 1,000 to about 3,000 revolutions per minute thereby enabling the formation of stable sized submicron particles, and which particles are of a volume average diameter of from about 50 to about 100 nanometers; adding said alkali halide solution, and accomplishing said heating to induce aggregation of said submicron pigmented particles to obtain toner size particles of from about 3 to about 10 microns in volume average diameter; and recovering, washing, and drying said toner; a process wherein said sulfonated polyester resin is in a molten form and is heated prior to flushing the colorant into the sulfonated polyester resin to obtain a flushed pigmented sulfonated polyester resin; a process wherein said sulfonated polyester resin is in a molten form and is heated prior to the simultaneous flushing of the colorant and organic soluble dye into the sulfonated polyester resin to obtain said flushed colorant sulfonated polyester resin; a process wherein an organic soluble dye is extruded into said flushed colorant sulfonated polyester resin by heating said resin to above the resin Tg and introducing the organic soluble dye by an extrusion process; a process wherein there is obtained a narrow toner GSD and which narrow is in the range of from about 1.18 to about 1.28; a process wherein the alkali metal halide is beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, or barium iodide; a process wherein said sulfonated polyester resin is heated at a temperature of from about 175° to about 200° C., and wherein the colorant to be flushed is added to said molten sulfonated polyester resin followed by vigorous stirring for a period of from about 10 minutes to about 120 minutes; a process wherein the colorant and the organic soluble dye to be flushed are added simultaneously to said molten sulfonated polyester resin followed by vigorous stirring for a period of from about 10 minutes to about 120 minutes; a process wherein said colorant sulfonated polyester resin mixture resulting is cooled, followed by water decantation, and vacuum drying; a process wherein the toner particle size is from 3 to about 7 microns, and wherein said toner is filtered, washed with water and dried; a process wherein the colorant is a pigment of carbon black, magnetite, cyan, yellow, magenta, or mixtures thereof; a process wherein the organic soluble dye is black, red, blue, yellow, or mixtures thereof; a process wherein there is added to the surface of the formed toner metal salts, metal salts of fatty acids, silicas, metal oxides, or mixtures thereof, each in an amount of from about 0.1 to about 10 weight percent of the obtained toner; a process wherein said sulfonated pigmented polyester is added to hot water at a temperature of from about 40° C. to about 95° C. thereby resulting in a stable dispersion containing submicron sized particles; and wherein the particle size of the dispersed sulfonated polyester is from about 5 to about 200 nanometers; a process wherein the polyester is random sulfonated copolyester comprised of, on a mol percent basis of the polymer repeat unit, about 0.465 terephthalate/0.035 sodium sulfoisophthalate/0.475 1,2-propanediol/0.025 diethylene glycol, and which polyester possesses an $M_w$ of about 3,160, an $M_n$ of about 1,500, and a Tg of about 55° C.; a process wherein the colorant is a pigment of carbon black, magnetite, cyan, yellow, magenta, or mixtures thereof, wherein the organic soluble dye is 2 to about 15 microns in volume average diameter; a process for the preparation of toner comprised of flushing a pigment into a polyester resin; mixing the resulting polyester resin with an organic soluble dye, and thereafter dispersing the resulting dye-pigmented polyester resin into warm water; cooling the resulting solution; adding an alkali halide solution, followed by heating; and a process wherein subsequent to heating cooling is accomplished and said toner is isolated, washed, and dried; and wherein said warm water is at a temperature of from about 40° C. to about 95° C. enabling the formation of submicron particles, and which particles are of a volume average diameter of from about 5 to about 150 nanometers; said cooling is from about 5° C. to about 10° C. below the glass transition temperature of said polyester resin, and which polyester resin is a sulfonated polyester; said alkali halide solution contains from about 0.5 percent to about 5 percent by weight of water; subsequently stirring and then heating from room temperature to a temperature below the resin Tg to induce aggregation of said submicron pigmented particles to obtain toner size particles of from about 1 to about 20 microns in volume average diameter.

Examples of the alkali halides that may be selected include beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, and barium iodide. The organic soluble dyes are known and are available from a number of sources, such as BASF, Bayer, Sigma Chemical Company, or Eastman Kodak, and examples of these dyes are contained in the Color Index, and include reds, yellows, blues, greens, oranges, browns, violets, and the like.

Various known colorants or pigments present in the toner in an effective amount of, for example, from about 1 to about 65, and preferably from about 2 to about 35 percent by weight of the toner, and more preferably in an amount of from about 1 to about 15 weight percent, include carbon black like REGAL 330®; magnetites, such as Mobay magnetites MO8029™, MO8060™; and the like. As colorants, especially pigments, there can be selected known cyan, magenta, yellow, red, green, brown, blue compounds or mixtures thereof. Specific examples of pigments include phthalocyanine HELIOGEN BLUE L6900™, D6840™, D7080™, D7020™, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy4-sulfonanilide phenylazo4'-chloro-2,5-dimethoxy acetoacetanilide, and Permanent Yellow FGL. Colored magnetites, such as mixtures of MAPICO BLACK™, and cyan components may also be selected as pigments with the process of the present invention. More specifically, pigment examples include Pigment Blue 15:3 having a Color Index Constitution Number of 74160, magenta pigment Red 81:3 having a Color Index Constitution Number of 45160:3, and Yellow 17 having a Color Index Constitution Number of 21105. The pigments can be selected in various suitable amounts, depending on the amount of dye selected, and more specifically, for example, from about 1 to about 25 percent by weight and preferably from about 5 to about 15 weight percent of the resin. Other suitable amounts of pigment can be selected.

Organic soluble dyes preferably of a high purity for the purpose of enhancing color gamut can be selected from a number of sources, such as indicated herein, and include, for example, Neopen Yellow 075, Neopen Yellow 159, Neopen Orange 252, Neopen Red 336, Neopen Red 355, Neopen Red 366, Neopen Blue 808, Neopen Black X53, Neopen Black X55 available from BASF, and the like, reference for example the emulsion/aggregation patents mentioned herein. The dyes are selected in various suitable amounts, for example from about 0.5 to about 40 percent by weight and preferably from about 5 to about 20 weight percent of the resin.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like. Other known charge additives may also be selected.

Surface additives that can be added to the toner compositions after washing or drying include, for example, metal salts, metal salts of fatty acids, colloidal silicas, titanium oxides, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate, titanium dioxide, and flow aids such as fumed silicas, and similar silicas available from Cabot Corporation and Degussa Chemicals, like AEROSIL R972® available from Degussa, each in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example U.S. Pat. Nos. 4,265,990; 4,584,253; 4,585,884 and 4,563,408, the disclosures of which are totally incorporated herein by reference.

The following Examples are being submitted to further define various species of the present invention. These examples are intended to be illustrative only and are not intended to limit the scope of the present invention. Also, parts and percentages are by weight unless otherwise indicated.

EXPERIMENTAL

Preparation of Sulfonated Polyesters

Preparation of Linear Moderately Sulfonated Polyester:

A linear sulfonated random copolyester resin comprised of a mol percent of approximately 0.465 terephthalate, 0.035 sodium sulfoisophthalate, 0.475 1,2-propanediol, and 0.025 diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethyl sulfoisophthalate, 310.94 grams of 1,2-propanediol (1 mole excess of glycols), 22.36 grams of diethylene glycol, (1 mole excess of the glycol) and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of the 3.5 mol percent sulfonated polyester resin, copoly(1,2-propylene-diethylene)terephthalate-copoly(sodium sulfoisophthalate dicarboxylate). The sulfonated polyester resin glass transition temperature was measured to be 54.6° C. (onset) utilizing the 910 Differential Scanning Calorimeter available from E. I. DuPont operating at a heating rate of 10° C. per minute. The number average molecular weight was measured to be 1,500 grams per mole, and the weight average molecular weight was measured to be 3,160 grams per mole using tetrahydrofuran as the solvent. This resin was utilized for the preparation of dye-toner particles in Examples I to IV.

Preparation of Flushed Dye-Pigmented Sulfonated Polyesters—Molten Flushed Process with Pigment Incorporation of Dye via Melt Extrusion:

Magenta:

To a sample (200 grams) of the above prepared molten polyester (>150° C.) in an explosion proof stainless steel batch mixer equipped with a high power to volume ratio sigma blade is rapidly added 50 percent of a Sun Fast Red 81:3 wet presscake, available from Sun Chemicals, which is comprised of 50 to 70 percent of 81:3 pigment solids by weight. Initial mixing is continued for 15 minutes, after which the remaining 50 percent of the presscake is slowly added to the reaction mixture over a 2 hour period. The reactor is then allowed to cool to 50° C. The water at the top of the reactor is decanted and the remaining water is removed by vacuum drying. The resulting pigmented polyester is heated to 175° C. and then discharged. The resulting composition of the dry toner resin prepared by this process is 85 percent sulfonated polyester and 15 percent of the flushed red 81:3 pigment. A sample (200 grams) of the resulting pigmented sulfonated polyester is again brought into the melt (150° to 175° C.) in a one liter Parr reactor and 5 grams of a red/magenta organic soluble dye (Neopen Red 336), available from BASF is dissolved into the melt. The polymer product is then extruded to yield a dye-pigmented magenta sulfonated polyester.

Cyan:

To a sample (200 grams) of the above prepared molten polyester (>150° C.) in an explosion proof stainless steel batch mixer equipped with a high power to volume ratio sigma blade is rapidly added 50 percent of a Sun Fast Pigment Blue 15:3 wet presseake, available from Sun Chemicals, which is comprised of 50 to 70 percent pigment solids by weight. Initial mixing is continued for 15 minutes, after which the remaining 50 percent of the presscake is slowly added to the reaction mixture over a 2 hour period. The reactor is then allowed to cool to 50° C. The water at the top of the reactor is decanted and the remaining water removed by vacuum drying. The pigmented polyester is then heated to 175° C. and then discharged. The resulting composition of the dry toner resin prepared by this process is 85 percent sulfonated polyester and 15 percent of the flushed Blue 15:3 pigment. A sample (200 grams) of the above pigmented sulfonated polyester product is introduced into the melt (150° to 175° C.) in a one liter Parr reactor and 5 grams of blue/cyan organic soluble dye (Neopen Blue 808), available from BASF, is dissolved into the melt. The polymer is then extruded to yield a dye-pigmented cyan sulfonated polyester.

Black:

To a sample (200 grams) of the above prepared molten polyester (>150° C.) in an explosion proof stainless steel batch mixer equipped with a high power to volume ratio sigma blade is rapidly added 50 percent of REGAL 330® carbon black wet presscake, available from Cabot Chemicals, which is comprised of 50 to 70 percent black pigment solids by weight. Initial mixing is continued for 15 minutes, after which the remaining 50 percent of the presscake is slowly added to the reaction mixture over a 2 hour period. The reactor is then allowed to cool to 50° C. The water at the top of the reactor is decanted and the remaining water removed by vacuum drying. The resulting pigmented polyester is heated to 175° C. and then discharged. The resulting dry toner composition prepared by this process is comprised of 85 percent sulfonated polyester and 15 percent of the flushed black pigment. A sample (200 grams) of the resulting pigmented sulfonated polyester is formed into a melt (150° to 175° C.) in a one liter Parr reactor and 5 grams of a black organic soluble dye (Neopen Black X53), available from BASF, is dissolved into the melt. The polymer product is then extruded to yield a dye-pigmented black sulfonated polyester.

Yellow:

To a sample (200 grams) of the above prepared molten polyester (>150° C.) in an explosion proof stainless steel batch mixer equipped with a high power to volume ratio sigma blade is rapidly added 50 percent of a Sun Fast Yellow 14 wet presscake, available from Sun Chemicals, which is comprised of 50 to 70 percent Yellow 14 pigment solids by weight. Initial mixing is continued for 15 minutes, after which the remaining 50 percent by weight (percent) of the presscake is slowly added to the reaction mixture over a 2 hour period. The reactor is then allowed to cool to 50° C. The water at the top of the reactor is decanted and the remaining water removed by vacuum drying. The resulting pigmented polyester is heated to 155° C. and then discharged. The resulting composition of the dry toner resin prepared by this process is 85 percent sulfonated polyester A and 15 percent of the flushed yellow pigment. A sample (200 grams) of the resulting pigmented sulfonated polyester was brought into a melt (150° to 175° C.) in a one liter Parr reactor and 5 grams of a yellow organic soluble dye (Neopen Yellow 075), available from Sun Chemicals, is dissolved into the melt. The polymer product is then extruded to yield a dye-pigmented yellow sulfonated polyester.

Molten Flushed Process—Simultaneous Flushing of Dye and Pigment

Magenta:

To a sample (200 grams) of the above prepared molten polyester (>150° C.) in an explosion proof stainless steel batch mixer equipped with a high power to volume ratio sigma blade is rapidly added 50 percent of a Sun Fast Red 81:3 wet presscake (available from Sun Chemicals, and which is comprised of 50 to 70 percent Red 81:3 pigment solids by weight) and 5 percent by weight of the organic soluble dye (Neopen Red 336), available from BASF. Initial mixing was continued for 15 minutes, after which the remaining 50 percent of the presscake is slowly added to the reaction mixture over a 2 hour period. The reactor is then allowed to cool to 50° C. The water at the top of the reactor is decanted and the remaining water removed by vacuum drying. The resulting dye-pigmented polyester is heated to 150° C. and then discharged. The resulting composition of the dry toner resin prepared by this process is 85 percent sulfonated polyester and 15 percent of the flushed red dye/pigment.

Cyan:

To a sample (200 grams) of the above prepared molten polyester (>150° C.) in an explosion proof stainless steel batch mixer equipped with a high power to volume ratio sigma blade is rapidly added 50 percent of a Sun Fast Pigment Blue 15:3 wet presscake (available from Sun Chemicals, and which is comprised of 50 to 70 percent 15:3 pigment solids by weight) and 5 percent by weight of the cyan organic soluble dye (Neopen Blue 808), available from BASF. Initial mixing is continued for 15 minutes, after which the remaining 50 percent of the presscake is slowly added to the reaction mixture over a 2 hour period. The reactor is then allowed to cool to 50° C. The water at the top of the reactor is decanted and the remaining water removed by vacuum drying. The resulting dye-pigmented polyester is heated to 150° C. and then discharged. The resulting composition of the dry toner resin is 85 percent sulfonated polyester and 15 percent of the flushed cyan dye/pigment.

Black:

To a sample (200 grams) of the above prepared molten polyester (>150° C.) in an explosion proof stainless steel batch mixer equipped with a high 10 power to volume ratio sigma blade is rapidly added 50 percent of carbon black, REGAL 330® of a wet presscake (available from Cabot, which is comprised of 50 to 70 percent black pigment solids by weight) and 5 percent by weight of the black organic soluble dye (Neopen Black X53), available from BASF Chemicals. Initial mixing is continued for 15 minutes, after which the remaining 50 percent of the presscake is slowly added to the reaction mixture over a 2 hour period. The reactor is then allowed to cool to 50° C. The water at the top of the reactor is decanted and the remaining water removed by vacuum drying. The resulting dye-pigmented polyester is heated to 150° C. and then discharged. There results 85 percent sulfonated polyester and 15 percent of the flushed black dye/pigment.

Yellow:

To a sample (200 grams) of the above prepared molten polyester (>150° C.) in an explosion proof stainless steel batch mixer equipped with a high power to volume ratio sigma blade is rapidly added 50 percent of a Sun Fast Yellow 14 wet presscake (available from Sun Chemicals, which is comprised of 50 to 70 percent yellow pigment solids by weight) and 5 percent by weight of the yellow organic soluble dye (Neopen Yellow 075), available from BASF. Initial mixing is continued for 15 minutes, after which the remaining 50 percent of the presscake is slowly added to the reaction mixture over a 2 hour period. The reactor is then allowed to cool to 50° C. The water at the top of the reactor is decanted and the remaining water removed by vacuum drying. The resulting dye-pigmented polyester is heated to 150° C. and then discharged. There results 85 percent sulfonated polyester and 15 percent of the flushed yellow dye/pigment.

Molten Flushed Process—Sequential Flushing of Dve and Pigment

Magenta:

To a sample (200 grams) of the above prepared molten polyester (>150° C.) in an explosion proof stainless steel batch mixer equipped with a high power to volume ratio sigma blade is rapidly added 50 percent of a Sun Fast Red 81:3 wet presscake (available from Sun Chemicals, and which is comprised of 50 to 70 percent 81:3 pigment solids by weight). Initial mixing is continued for 15 minutes, after which the remaining 50 percent of the presscake is slowly added to the reaction mixture over a 2 hour period. 5 Percent by weight of the organic soluble dye (Neopen Red 336), available from BASF, is then introduced into the pigmented sulfonated polyester with stirring for an additional 30 minutes. The reactor is then allowed to cool to 50° C. The water at the top of the reactor is decanted and the remaining water removed by vacuum drying. The resulting dye-pigmented polyester is heated to 150° C. and then discharged. There results 85 percent sulfonated polyester and 15 percent of the flushed magenta dye/pigment.

Cyan:

To a sample (200 grams) of the above prepared molten polyester (>150° C.) in an explosion proof stainless steel batch mixer equipped with a high power to volume ratio sigma blade is rapidly added 50 percent of a Sun Fast Pigment Blue 15:3 wet presseake (available from Sun Chemicals, and which is comprised of 50 to 70 percent 15:3 pigment solids by weight). Initial mixing is continued for 15 minutes, after which the remaining 50 percent of the presscake is slowly added to the reaction mixture over a 2 hour period. 5 Percent by weight of the cyan organic soluble dye (Neopen Blue 808), available from BASF, is then introduced into the pigmented sulfonated polyester with stirring for an additional 30 minutes. The reactor is then allowed to cool to 50° C. The water at the top of the reactor is decanted and the remaining water removed by vacuum drying. The resulting dye-pigmented polyester is heated to 150° C. and then discharged. There results 85 percent sulfonated polyester and 15 percent of the flushed cyan dye/pigment.

Black:

To a sample (200 grams) of the above prepared molten polyester (>150° C.) in an explosion proof stainless steel batch mixer equipped with a high power to volume ratio sigma blade is rapidly added 50 percent of REGAL 330® carbon black of a wet presscake (available from Cabot, and which is comprised of 50 to 70 percent black pigment solids by weight). Initial mixing is continued for 15 minutes, after which the remaining 50 percent of the presscake is slowly added to the reaction mixture over a 2 hour period. 5 Percent by weight of the black organic soluble dye (Neopen Black X53), available from BASF, is then introduced into the pigmented black sulfonated polyester with stirring for an additional 30 minutes. The reactor is then allowed to cool to 50° C. The water at the top of the reactor is decanted and the remaining water removed by vacuum drying. The resulting dye-pigmented polyester is heated to 150° C. and then discharged. There results 85 percent sulfonated polyester and 15 percent of the flushed black dye/pigment.

Yellow:

To a sample (200 grams) of the above prepared molten polyester (>150° C.) in an explosion proof stainless steel batch mixer equipped with a high power to volume ratio sigma blade is rapidly added 50 percent of a Sun Fast Yellow 14 wet presscake (available from Sun Chemicals, which is comprised of 50 to 70 percent yellow pigment solids by weight). Initial mixing is continued for 15 minutes, after which the remaining 50 percent of the presscake is slowly added to the reaction mixture over a 2 hour period. 5 Percent by weight of the yellow organic soluble dye (Neopen Yellow 075), available from BASF is then introduced into the pigmented sulfonated polyester with stirring for an additional 30 minutes. The reactor is then allowed to cool to 50° C. The water at the top of the reactor is decanted and the remaining water removed by vacuum drying. The resulting dye-pigmented polyester is heated to 150° C. and then discharged. There results 85 percent sulfonated polyester and 15 percent of the flushed yellow dye/pigment.

Preparation of Chemical Toners Via an Emulsion/Aggregation Process

EXAMPLE I (Magenta)

Dye-Pigmented Sulfonated Polyester:

A 200 gram sample of the above prepared red dye-pigmented polyester utilizing a 1:10 ratio of dye (Neopen Red 336, BASF) and pigment (Sun Fast Red 81:3, Sun Chemicals) prepared by either a direct flushing of pigment and dye into the sulfonated polyester or optionally by incorporation of the oil soluble dye via extrusion of a pigmented polyester is dissipated within 7 minutes by the addition of this sample, with stirring, to 500 milliliters of hot water (75° C.) in a glass reactor. Stable, submicron sized particles (40 nanometers) are formed. Aggregation to micron size particles is accomplished by heating the stable dispersion to 46° C., and adding dropwise, with stirring, a 1 percent solution of $MgCl_2$. Addition (7 milliliters of 1 percent $MgCl_2$ solution) is continued until gelation is observed. The reactor temperature is raised to 48.5° C. and stirring is continued for an additional 30 minutes. A toner particle size of 5.8 microns and 1.26 GSD results. The magenta toner particles are recovered by filtering, washing with cold water, and then vacuum drying the sample. Toners prepared in this manner exhibit fusing performance which are comparable to similar toners obtained by conventional extrusion and classification processes.

EXAMPLE II (Cyan)

Dye-Piqmented Sulfonated Polyester:

A 200 gram sample of the above prepared cyan dye-pigmented polyester utilizing a 1:10 ratio of dye (Neopen Blue 808, BASF) and pigment (Sun Fast Pigment Blue 15:3, Sun Chemicals) prepared by either a direct flushing of pigment and dye into the sulfonated polyester, or optionally by incorporation of the oil soluble dye via extrusion of a pigmented polyester is dissipated within 7 minutes by the addition of the mixture, with stirring, to 500 milliliters of hot water (75° C.) in a glass reactor. Stable, submicron sized particles (40 nanometers) are formed. Aggregation to micron size particles is accomplished by heating (after cooling throughout) the stable dispersion to 46° C., and adding dropwise, with stirring, a 1 percent solution of $MgCl_2$. Addition (7 milliliters of 1 percent $MgCl_2$ solution) is continued until gelation is observed. The reactor temperature is raised to 48.50° C. and stirring is continued for an additional 30 minutes. A toner particle size of 5.8 microns and 1.26 GSD results. The cyan toner particles are recovered by first filtering, washing with cold water, and then vacuum drying the sample. Toners prepared in this manner exhibit fusing performance which is comparable to toners obtained by conventional process.

EXAMPLE III (Yellow)

Dye-Pigmented Sulfonated Polyester:

A 200 gram sample of the above prepared yellow dye-pigmented polyester utilizing a 1:10 ratio of dye (Neopen Yellow 075, BASF) and pigment (Sun Fast Yellow 14, Sun Chemicals) prepared by either a direct flushing of pigment and dye into the sulfonated polyester, or optionally by incorporation of the oil soluble dye via extrusion of a pigmented polyester is dissipated within 7 minutes by the addition of the sample, with stirring, to 500 milliliters of hot water (75° C.) in a glass reactor. Stable, submicron sized particles (40 nanometers) are formed after cooling. Aggregation to micron size particles is accomplished by heating the stable dispersion to 46° C., and adding dropwise, with stirring, a 1 percent solution of $MgCl_2$. Addition (7 milliliters of 1 percent $MgCl_2$ solution) is continued until gelation is observed. The reactor temperature is increased to 48.5° C. and stirring is continued for an additional 30 minutes. A toner particle size of 5.8 microns and 1.26 GSD are observed. The yellow toner particles are recovered by filtering, washing with cold water, and then vacuum drying. Toners prepared in this manner exhibit fusing performance which is comparable to toners obtained by conventional process.

Particle size and GSD are determined by known methods, such as a Coulter Counter, as indicated hereinbefore.

EXAMPLE IV (Black)

Dye-Pigmented Sulfonated Polyester:

A 200 gram sample of the above prepared cyan dye-pigmented polyester with a 1:10 ratio of dye (Neopen Black X53, BASF) and carbon black pigment (REGAL 330®, Cabot) prepared by either a direct flushing of pigment and dye into the sulfonated polyester, or optionally by incorporation of the oil soluble dye via extrusion of a pigmented polyester is dissipated within 7 minutes by the addition of the sample, with stirring, to 500 milliliters of hot water (75° C.) in a glass reactor. Stable, submicron sized particles (40 nanometers) are formed. Aggregation to micron size particles is accomplished by heating the stable dispersion to 46° C., and adding dropwise, with stirring, a 1 percent solution of $MgCl_2$. Addition (7 milliliters of 1 percent $MgCl_2$ solution) is continued until gelation is observed. The reactor temperature is raised to 48.5° C. and stirring is continued for an additional 30 minutes. A toner particle size of 5.8 microns and 1.26 GSD are observed. The black toner particles are recovered by filtering, washing with cold water, and then vacuum drying the sample. Toners prepared in this manner exhibit fusing performance which is comparable to similar toners obtained by conventional process.

Other modifications of the present invention may occur to those of ordinary skill in the art subsequent to a review of the present application and these modifications, including equivalents and substantial equivalents thereof, are intended to be included within the scope of the present invention.

What is claimed is:

1. A process for the preparation of toner which comprises i) flushing a pigment into a sulfonated polyester resin;

ii) mixing an organic soluble dye with the colorant polyester resin of i);

iii) dispersing the resulting mixture into warm water thereby enabling the formation of submicron particles;

iv) allowing the resulting solution to cool below about, or about equal to the glass transition temperature of said sulfonated polyester resin;

v) adding an alkali halide solution and heating; and optionally vi) recovering said toner, followed by washing and drying.

2. A process in accordance with claim 1 wherein i) said sulfonated polyester resin has a sulfonation amount of from about 2.5 and about 20 mol percent based on the repeat unit of the polymer;

ii) said mixing is accomplished by melt mixing an organic soluble dye into the pigment polyester resin of i);

iii) wherein said water is at a temperature of from about 40° C. to about 95° C., and which dispersion is by a high speed shearing polytron device operating at speeds of from about 100 to about 5,000 revolutions per minute thereby enabling the formation of stable submicron particles, and which particles are of a volume average diameter of from about 5 to about 150 nanometers;

iv) allowing the resulting solution to cool to from about 5 to about 10° C. below the glass transition temperature of said sulfonated polyester resin;

v) adding an alkali halide solution, which solution contains from about 0.5 percent to about 5 percent by weight of water, followed by stirring and heating from about 25° C. to a temperature below the sulfonated polyester resin Tg to induce aggregation of said submicron particles to obtain toner size particles of from about 1 to about 20 microns in volume average diameter; or subsequently stirring and heating to a temperature below the resin Tg, followed by the addition of alkali metal halide until the desired toner size of from about 1 to about 20 microns in volume average diameter is achieved; and vi) recovering said toner by filtration, followed by washing and drying, and thereafter optionally blending charge enhancing additives and flow additives.

3. A process for the preparation of toner comprised of i) flushing a pigment and organic soluble dye into a sulfonated polyester resin, and which resin has a degree of sulfonation of from between about 2.5 and about 20 mol percent based on the repeat unit of the polymer;

ii) dispersing the resulting sulfonated pigment polyester resin into warm water, which water is at a temperature of from about 40° C. to about 95° C. by a high speed shearing polytron device operating at speeds of from about 100 to about 5,000 revolutions per minute thereby enabling the formation of stable toner sized submicron particles, and which particles are of a volume average diameter of from about 5 to about 150 nanometers;

iii) allowing the resulting solution to cool to from about 5° C. to about 10° C. below the glass transition temperature of said pigment sulfonated polyester resin;

iv) adding an alkali halide solution, which solution contains from about 0.5 percent to about 5 percent by weight of water, followed by stirring and heating from about room temperature, about 25° C., to a temperature below the resin Tg to induce aggregation of said submicron particles to obtain toner size particles of from about 2 to about 20 microns in volume average diameter; or subsequently stirring and heating to a temperature below the resin Tg, followed by the addition of alkali metal halide until the desired toner size of from about 2 to about 20 microns in volume average diameter is achieved; and optionally v) recovering said toner, washing and drying said toner.

4. A process in accordance with claim 3 wherein for i) there is accomplished the simultaneous flushing of pigment and organic soluble dye, or sequential flushing of said pigment then subsequently said organic soluble dye into said sulfonated polyester resin; wherein said water is at a temperature of from about 40° C. to about 75° C., and said dispersing is by a high speed shearing polytron device operating at speeds of from about 1,000 to about 3,000 revolutions per minute thereby enabling the formation of stable sized submicron particles, and which particles are of a volume average diameter of from about 50 to about 100 nanometers; adding said alkali halide solution, and accomplishing said heating to induce aggregation of said submicron pigmented particles to obtain toner size particles of from about 3 to about 10 microns in volume average diameter; and recovering, washing, and drying said toner.

5. A process in accordance with claim 1 wherein said sulfonated polyester resin is in a molten form and is heated prior to flushing the pigment into the sulfonated polyester resin to obtain a flushed pigmented sulfonated polyester resin.

6. A process in accordance with claim 3 wherein said sulfonated polyester resin is in a molten form and is heated prior to the simultaneous flushing of the pigment and organic soluble dye into the sulfonated polyester resin to obtain said flushed pigment sulfonated polyester resin.

7. A process in accordance with claim 6 wherein an organic soluble dye is extruded into said flushed pigment sulfonated polyester resin by heating said resin to above the resin Tg and introducing the organic soluble dye by an extrusion process.

8. A process in accordance with claim 1 wherein there is obtained a narrow toner GSD and which narrow is in the range of from about 1.18 to about 1.28.

9. A process in accordance with claim 1 wherein the alkali metal halide is beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, or barium iodide.

10. A process in accordance with claim 1 wherein said sulfonated polyester resin is heated at a temperature of from about 175° to about 200° C., and wherein the pigment to be flushed is added to said molten sulfonated polyester resin followed by vigorous stirring for a period of from about 10 minutes to about 120 minutes.

11. A process in accordance with claim 3 wherein the pigment and the organic soluble dye to be flushed are added simultaneously to said molten sulfonated polyester resin followed by vigorous stirring for a period of from about 10 minutes to about 120 minutes.

12. A process in accordance with claim 11 wherein said pigment sulfonated polyester resin mixture resulting is cooled, followed by water decantation, and vacuum drying.

13. A process in accordance with claim 1 wherein the toner particle size is from 3 to about 7 microns, and wherein said toner is filtered, washed with water and dried.

14. A process in accordance with claim 1 wherein the colorant pigment is carbon black, magnetite, cyan, yellow, magenta, or mixtures thereof.

15. A process in accordance with claim 1 wherein the organic soluble dye is black, red, blue, yellow, or mixtures thereof.

16. A process in accordance with claim 1 wherein there is added to the surface of the formed toner metal salts, metal salts of fatty acids, silicas, metal oxides, or mixtures thereof, each in an amount of from about 0.1 to about 10 weight percent of the obtained toner.

17. A process in accordance with claim 1 wherein said sulfonated pigmented polyester is added to hot water at a temperature of from about 40° C. to about 95° C. thereby resulting in a stable dispersion containing submicron sized particles; and wherein the particle size of the dispersed sulfonated polyester is from about 5 to about 200 nanometers.

18. A process in accordance with claim 1 wherein the polyester is random sulfonated copolyester comprised of, on a mol percent basis of the polymer repeat unit, about 0.465 terephthalate/0.035 sodium sulfoisophthalate0.475 1,2-propanediol/0.025 diethylene glycol, and which polyester possesses an $M_w$ of about 3,160, an $M_n$ of about 1,500, and a Tg of about 55° C.

19. A process in accordance with claim 1 wherein the pigment is carbon black, magnetite, cyan, yellow, magenta, or mixtures thereof, wherein the organic soluble dye is 2 to about 15 microns in volume average diameter.

20. A process for the preparation of toner comprised of flushing a pigment into a polyester resin; mixing the resulting polyester resin with an organic soluble dye, and thereafter dispersing the resulting dye-pigmented polyester resin into warm water; cooling the resulting solution; adding an alkali halide solution, followed by heating.

21. A process in accordance with claim 20 wherein subsequent to heating cooling is accomplished and said toner is isolated, washed, and dried; and wherein said warm water is at a temperature of from about 40° C. to about 95° C. enabling the formation of submicron particles, and which particles are of a volume average diameter of from about 5 to about 150 nanometers; said cooling is from about 5° C. to about 10° C. below the glass transition temperature of said polyester resin, and which polyester resin is a sulfonated polyester; said alkali halide solution contains from about 0.5 percent to about 5 percent by weight of water; subsequently stirring and then heating from room temperature to a temperature below the resin Tg to induce aggregation of said submicron pigmented particles to obtain toner size particles of from about 1 to about 20 microns in volume average diameter.

* * * * *